US008215014B2

(12) United States Patent
Amburgey

(10) Patent No.: US 8,215,014 B2
(45) Date of Patent: Jul. 10, 2012

(54) METHOD FOR MAKING A STATOR

(75) Inventor: Michael D. Amburgey, London, OH (US)

(73) Assignee: Moyno, Inc., Springfield, OH (US)

( * ) Notice: Subject to any disclaimer, the term of this patent is extended or adjusted under 35 U.S.C. 154(b) by 951 days.

(21) Appl. No.: 11/931,372

(22) Filed: Oct. 31, 2007

(65) Prior Publication Data

US 2009/0110579 A1 Apr. 30, 2009

(51) Int. Cl.
*B21D 26/02* (2006.01)
*B23P 15/00* (2006.01)
*B23P 17/00* (2006.01)

(52) U.S. Cl. ..... 29/888.02; 29/421.1; 72/370.22; 418/48

(58) Field of Classification Search ..... 29/421.1, 29/888.02; 72/58, 61, 370.22; 417/440; 418/48, 153
See application file for complete search history.

(56) References Cited

U.S. PATENT DOCUMENTS

| | | | | |
|---|---|---|---|---|
| 2,512,764 | A | 6/1950 | Byram | |
| 2,527,673 | A | 10/1950 | Byram | |
| 2,612,845 | A | 10/1952 | Byram et al. | |
| 3,011,445 | A | 12/1961 | Bourke | |
| 3,084,631 | A | 4/1963 | Bourke | |
| 3,512,904 | A | 5/1970 | Allen | |
| 3,625,040 | A * | 12/1971 | Gain | 72/59 |
| 3,651,685 | A * | 3/1972 | Tominaga | 72/402 |
| 4,424,013 | A | 1/1984 | Bauman | |
| 5,145,342 | A * | 9/1992 | Gruber | 418/48 |
| 5,145,343 | A | 9/1992 | Belcher | |
| 5,205,721 | A | 4/1993 | Isaacson | |
| 5,318,416 | A | 6/1994 | Hantschk et al. | |
| 5,474,432 | A | 12/1995 | Hulley et al. | |
| 5,688,114 | A | 11/1997 | Millington et al. | |
| 5,722,820 | A | 3/1998 | Wild et al. | |
| 6,082,980 | A | 7/2000 | Papin | |
| 6,120,267 | A | 9/2000 | Cunningham | |
| 6,162,032 | A | 12/2000 | Jager | |
| 6,336,796 | B1 | 1/2002 | Cholet et al. | |
| 6,491,501 | B1 | 12/2002 | Wild et al. | |
| 6,497,030 | B1 * | 12/2002 | Marando | 29/421.1 |
| 6,572,351 | B2 | 6/2003 | Durand et al. | |
| 6,666,668 | B1 | 12/2003 | Kaechele | |
| 6,749,954 | B2 * | 6/2004 | Toyooka et al. | 428/683 |
| 6,872,061 | B2 | 3/2005 | Lemay et al. | |
| 6,886,330 | B1 | 5/2005 | Turner | |
| 7,214,042 | B2 | 5/2007 | Parrett | |
| 7,441,432 | B2 * | 10/2008 | Ingvarsson | 72/62 |
| 2006/0029507 | A1 * | 2/2006 | Kaiser et al. | 418/48 |

(Continued)

FOREIGN PATENT DOCUMENTS

| | | |
|---|---|---|
| DE | 2313261 | 9/1974 |

(Continued)

OTHER PUBLICATIONS

U.S. Appl. No. 11/928,842, filed Oct. 30, 2007, Amburgey et al.

(Continued)

*Primary Examiner* — Alexander P Taousakis
(74) *Attorney, Agent, or Firm* — Thompson Hine L.L.P.

(57) ABSTRACT

A method for making a stator assembly including the steps of providing a generally cylindrical stator casing, hydroforming the stator casing into a generally helical shape, and positioning a stator liner having a generally helical shape inside the stator casing.

16 Claims, 5 Drawing Sheets

U.S. PATENT DOCUMENTS

| | | | | |
|---|---|---|---|---|
| 2006/0182644 | A1 | 8/2006 | Delpassand et al. | |
| 2007/0140882 | A1* | 6/2007 | Kachele | 418/45 |

FOREIGN PATENT DOCUMENTS

| | | |
|---|---|---|
| DE | 4413818 | 10/1995 |
| DE | 10241753 | 11/2003 |
| DE | 102004038477 | 10/2005 |
| DE | 102008021920 | 2/2009 |
| EP | 0612922 | 8/1994 |
| EP | 0943803 | 9/1999 |
| EP | 0994256 | 4/2000 |
| FR | 1488652 | 6/1967 |
| WO | 2009/024279 | 2/2009 |

OTHER PUBLICATIONS

U.S. Appl. No. 11/928,929, filed Oct. 30, 2007, Parrett et al.
English Translation of French Patent No. 1488652 (Streicher et al.), filed Aug. 3, 1966, issued Jun. 5, 1967.

* cited by examiner

METHOD FOR MAKING A STATOR

The present invention is directed to an equal wall stator, and more particularly, to an equal wall stator for use with, or as part of, a progressing cavity pump.

BACKGROUND

Progressing cavity pumps may be used in various industries to pump materials such as solids, semi-solids, fluids with solids in suspension, highly viscous fluids and shear sensitive fluids, including chemicals, oil, sewage, or the like. A typical progressing cavity pump (also known as a helical gear pump) includes a rotor having one or more externally threaded helical lobes which cooperate with a stator having an internal bore extending axially therethrough. The bore includes a plurality of helical grooves that forms a plurality of cavities with the stator. As the rotor turns within the stator, the cavities progress from the suction end of the pump to the discharge end.

SUMMARY

In one embodiment the present invention is an equal wall stator, and/or a method for making an equal wall stator.

More particularly, in one embodiment the present invention is a method for making a stator assembly including the steps of providing a generally cylindrical stator casing, hydroforming the stator casing into a generally helical shape, and positioning a stator liner having a generally helical shape inside the stator casing.

In another embodiment, the invention is a method for making a stator including the steps of providing a generally cylindrical stator component and hydroforming the stator component into a generally helical shape. The hydroforming step includes filling the stator component with a fluid, placing a mold about the stator component, and increasing the pressure of the fluid by inserting an intensifier rod into the stator component to cause the stator component to expand radially outwardly and conform to the mold. The hydroforming step includes placing the stator component in a state of compression, wherein the compression of the stator component and the movement of the intensifier rod are independently controlled.

DETAILED DESCRIPTION

Figure 1:
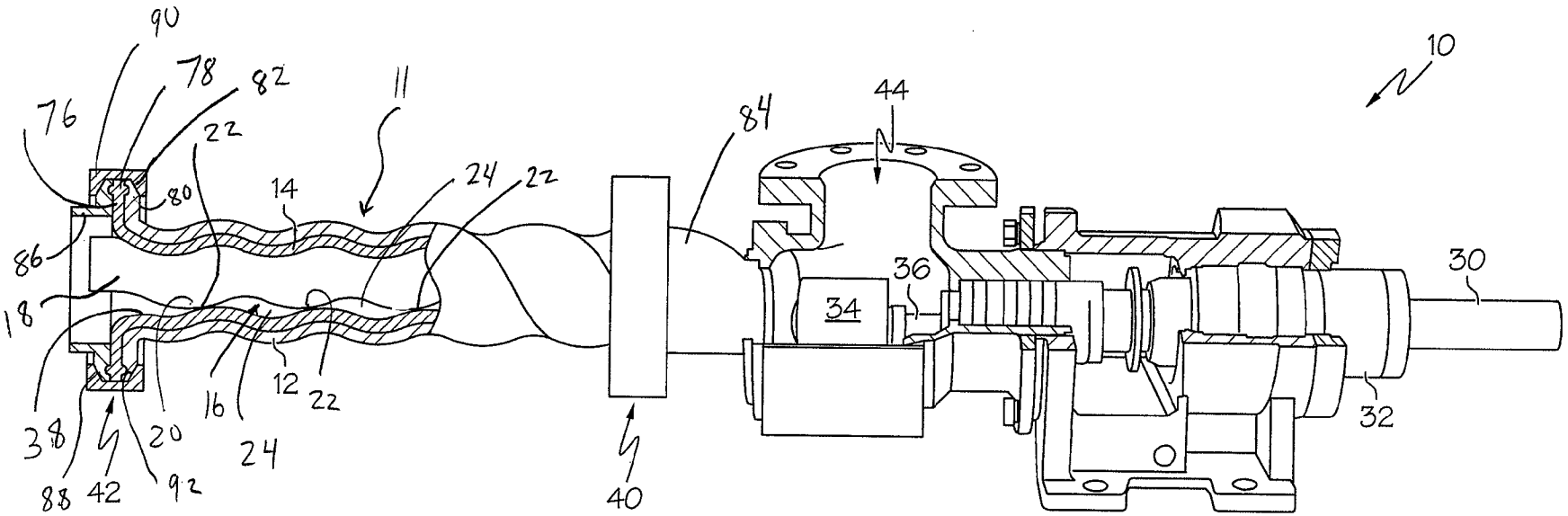
FIG. 1 is a front perspective, partial cutaway view of one embodiment of the pump of the present invention.

As shown in FIG. 1, the progressing cavity pump 10 of the present invention may include a stator or stator assembly 11 including a stator tube or casing 12 having a stator liner 14 located therein. The stator liner 14 has an opening or internal bore 16 extending generally longitudinally therethrough in the form of a double lead helical nut to provide an internally threaded stator 11. The pump 10 includes an externally threaded rotor 18 in the form of a single lead helical screw rotationally received inside stator 11. The rotor 18 may include a single external helical lobe 20, with the pitch of the lobe 20 being twice the pitch of the internal helical grooves.

The rotor 18 fits within the stator bore 16 to provide a series of helical seal lines 22 where the rotor 18 and stator 11 contact each other or come in close proximity to each other. In particular, the external helical lobe 20 of the rotor 18 and the internal helical grooves of the stator liner 14 define the plurality of cavities 24 therebetween. The stator liner 14 has an inner surface 38 which the rotor 18 contacts or nearly contacts to create the cavities 24. The seal lines 22 define or seal off defined cavities 24 bounded by the rotor 18 and stator liner 14 surfaces.

The rotor 18 may be rotationally coupled to a drive shaft 30 by a pair of gear joints 32, 34 and by a connecting rod 36. The drive shaft 30 is rotationally coupled to a motor (not shown). Thus, when the motor rotates the drive shaft 30, the rotor 18 is rotated about its central axis and eccentrically rotates within the stator 11. As the rotor 18 turns within the stator 11, the cavities 24 progress from an inlet or suction end 40 of the rotor/stator pair to an outlet or discharge end 42 of the rotor/stator pair.

The pump 10 includes a suction chamber 44 in fluid communication with the inlet end 40 into which materials to be pumped may be introduced. During a single 360° revolution of the rotor 18, one set of cavities 24 is opened or created at the inlet end 40 at exactly the same rate that a second set of cavities 24 is closing or terminating at the outlet end 42 which results in a predictable, pulsationless flow of pumped material/fluid.

The pitch length of the stator liner 14 may be twice that of the rotor 18, and the present embodiment illustrates a rotor/stator assembly combination known as 1:2 profile elements, which means the rotor 18 has a single lead and the stator 11 has two leads. However, the present invention can also be used with any of a variety of rotor/stator configurations, including more complex progressing cavity pumps such as 9:10 designs where the rotor 18 has nine leads and the stator 11 has ten leads. In general, nearly any combination of leads may be used so long as the stator 11 has one more lead than the rotor 18. U.S. Pat. Nos. 2,512,764, 2,612,845, and 6,120,267, the entire contents of which are hereby incorporated by reference, provide additional information on the operation and construction of progressing cavity pumps.

The stator liner 14 can be made of a relatively soft material, such as silicone, plastic, durometer rubber, nylon, elastomers, nitrile rubber, natural rubber, synthetic rubber, fluoroelastomer rubber, urethane, ethylene-propylene-diene monomer ("EPDM") rubber, polyolefin resins, perfluoroelastomer, hydrogenated nitriles and hydrogenated nitrile rubbers, polyurethane, epichlorohydrin polymers, thermoplastic polymers, polytetrafluoroethylene ("PTFE"), polychloroprene (such as Neoprene), synthetic elastomers such as HYPALON® polyolefin resins and synthetic elastomers sold by E. I. du Pont de Nemours and Company located in Wilmington Del., RULON® resinous material sold by Saint-Gobain Performance Plastics Corporation of Wayne, N.J., synthetic rubber such as KALREZ® synthetic rubber sold by E. I. du Pont de Nemours and Company, tetrafluoroethylene/propylene copolymer such as AFLAS® tetrafluoroethylene/propylene copolymer sold by Asahi Glass Co., Ltd. of Tokyo, Japan, acid-olefin interpolymers such as CHEMROZ® acid-olefin interpolymers sold by Chemfax, Incorporated of Gulfport Miss., and various other materials. The helical groove of the stator liner 14 and/or the lobe 20 of the rotor 18 may be shaped and sized to form a compressive fit therebetween to allow the progressing cavity pump 10 to self-prime, suction, lift fluids and pump against a pressure (i.e., pump materials against a back pressure).

Alternately, the stator liner 14 may be made of a relatively rigid material, such as steel, carbon steel, tool steel, TEFLON® fluorinated hydrocarbons and polymers sold by E.I. duPont de Nemours and Company, A2 tool steel, 17-4 PH stainless steel, crucible steel, 4150 steel, 4140 steel or 1018 steel, polished stainless steel or nearly any stainless, carbon or alloy steels, or other suitable materials which can be cast or machined. When a rigid stator liner 14 is utilized, the stator casing 16 may be omitted. Moreover, when a rigid stator liner 14 is utilized the stator 11 and rotor 18 may have a gap or clearance therebetween, which provides high pumping efficiencies, especially for high viscosity fluids.

The rotor 18 can be made of any of a wide variety of materials, including steel or any of the materials listed above for the rigid stator liner 14. The stator casing 16 can be made of any of a wide variety of materials, including metal or any of the materials listed above for the relatively rigid stator liner 14, and could also be made of rigid plastic or composite materials.

The stator 11 may be an equal wall stator or constant thickness stator; that is, both the stator tube 12 and the stator liner 14, or the stator tube 12 alone, or the stator liner 14 alone (when no stator tube 12 is utilized) may have a generally constant thickness along their lengths. In this case, both the inner and outer surfaces of the stator tube 12 and/or stator liner 14 are formed as a helical nut. The equal wall nature of the stator 11 provides a materials savings compared to, for example, a stator tube 12 which has a smooth or cylindrical outer surface in which the outer grooves can be considered to be "filled in," which requires additional material and adds weight to the stator 11.

Figure 2:
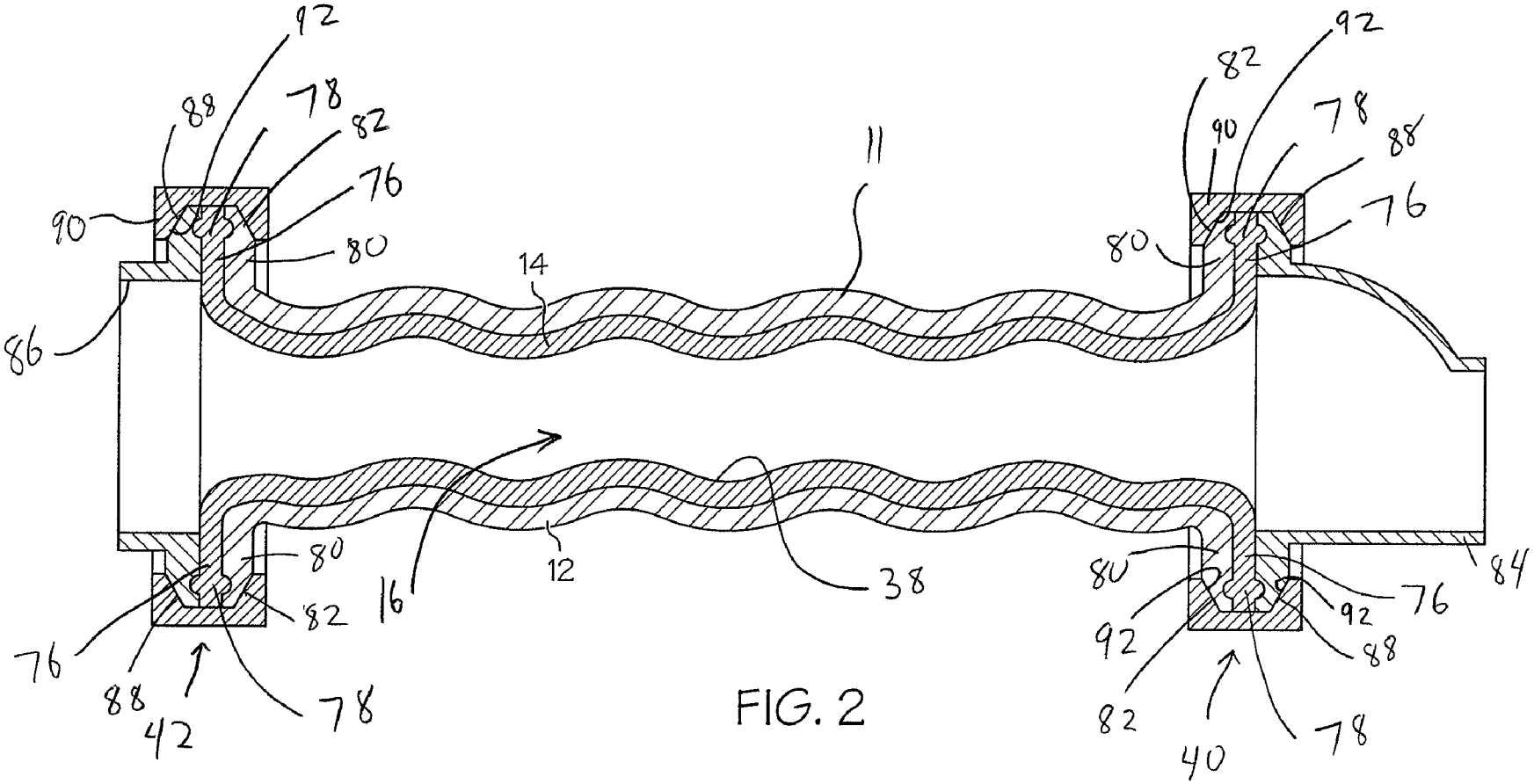
FIG. 2 is a side cross section of the stator of the pump of FIG. 1 and adjacent components.
Figure 3:
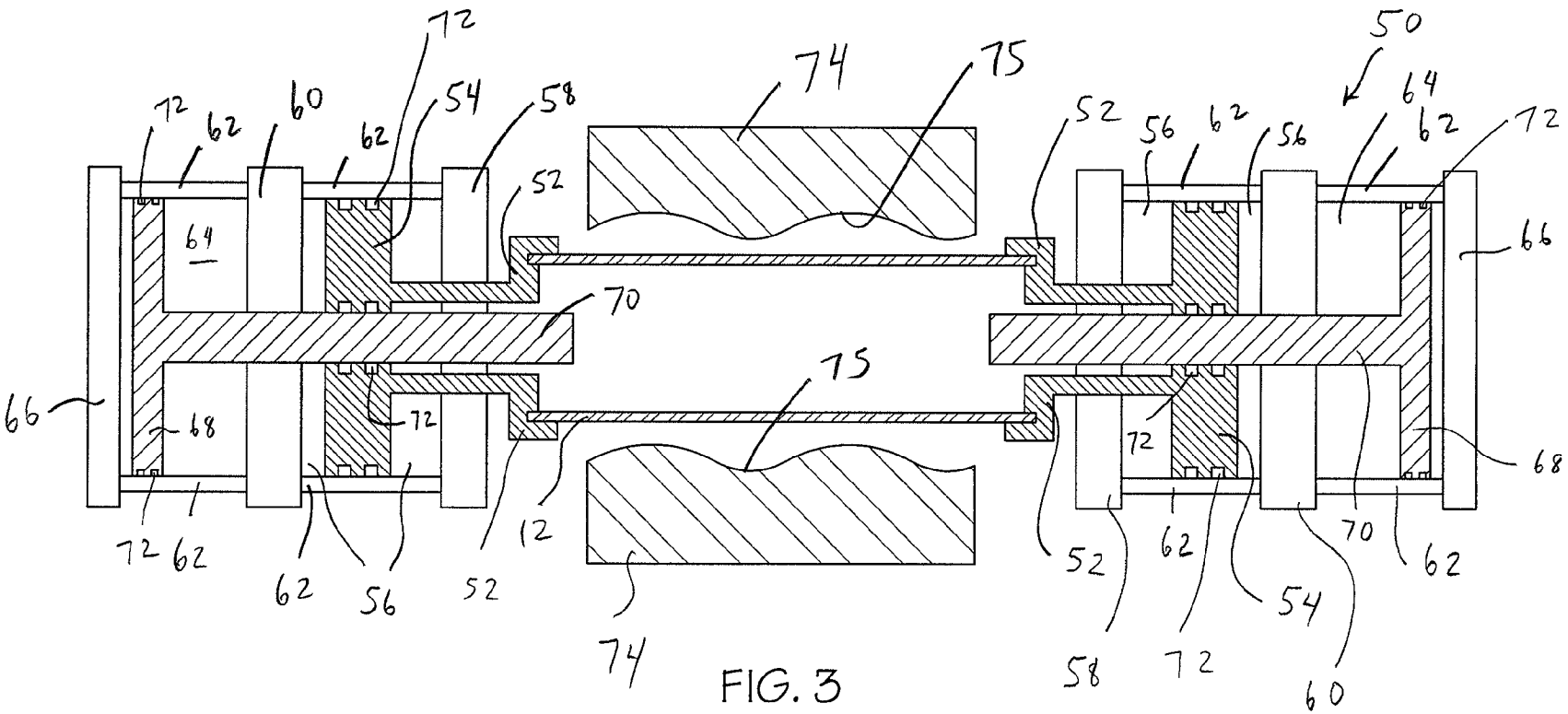
FIG. 3 is a side cross section illustrating a stator tube forming device receiving an unformed stator tube.
Figure 4:
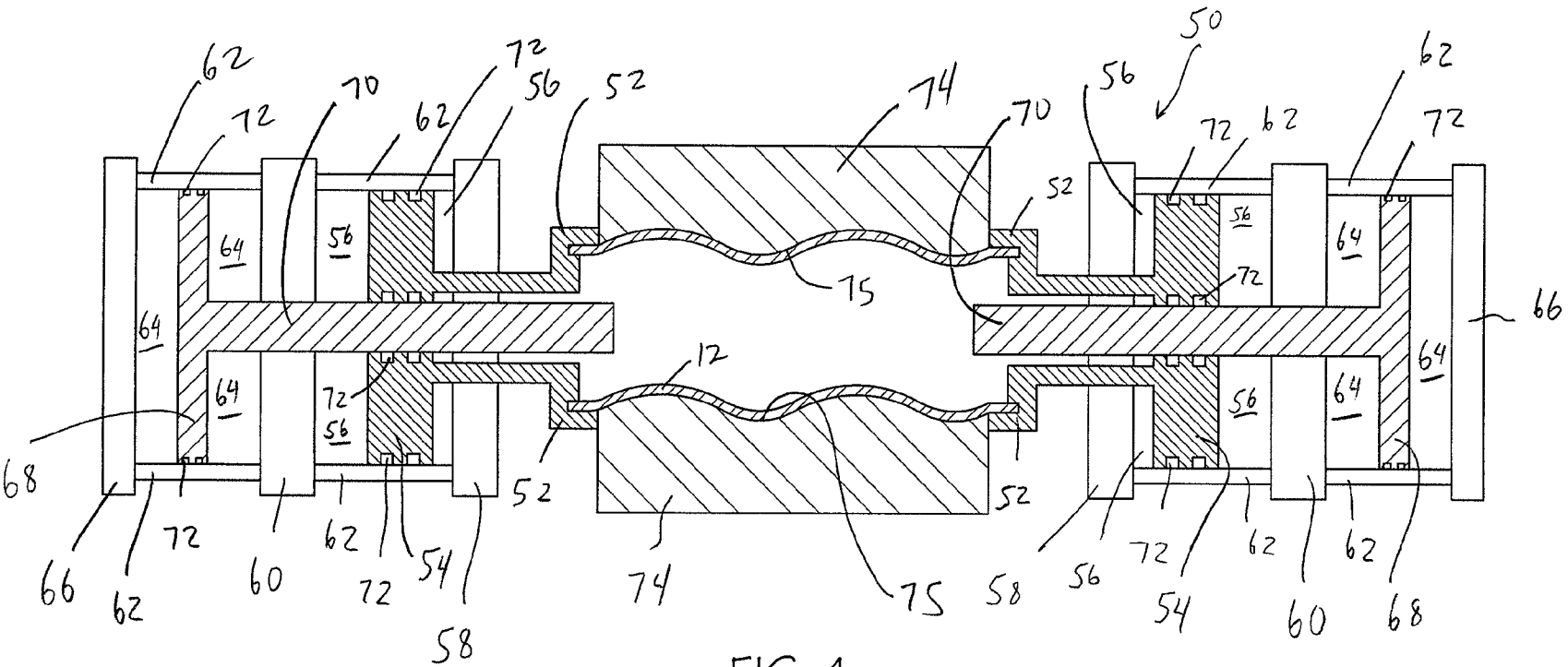
FIG. 4 is a side cross section of the stator tube forming device of FIG. 3, in the process of forming the stator tube.

In order to form the equal wall stator 11 of FIGS. 1 and 2, the stator tube 12 may be formed using the stator tube forming device 50 as shown in FIGS. 3 and 4. The stator tube forming device 50 may include a pair of opposed clamps 52 which received the unformed stator tube 12 therein. Each clamp 52 is fixedly coupled to a forming cylinder/piston 54. Each forming cylinder 54 is positioned in a forming chamber 56 that is defined by an inner wall 58, and intermediate wall 60, and an outer cylindrical containing wall 62.

Positioned immediately adjacent to each forming chamber 58 is an intensifier chamber 64 defined by the associated intermediate wall 60, cylindrical containing wall 62, and an outer wall 66. An intensifier cylinder/piston 68 is positioned in each intensifier chamber 64, and an intensifier rod 70 is coupled to each intensifier cylinder 68. Each intensifier rod 70 extends through the associated intermediate wall 60, forming cylinder 54 and inner wall 58, and passes through an associated clamp 52. A set of seals 72 may be positioned between each forming cylinder 54 and the associated intensifier rod 70 and between each cylinder 54, 68 and the cylindrical wall 62. In addition, if desired, a set of seals (not shown) may be positioned between each wall 58, 60 and the associated intensifier rod 70.

The stator forming device 50 may include or take the form of a hot hydroforming machine. For example, a split die 74, which has an inner surface 75 in the desired (helical nut) shape of the stator tube 12, is provided and positioned about the stator tube 12, and clamped in place about the unformed stator 12 (as shown in FIG. 4). Fluid (such as water, hydraulic fluid or the like) is introduced inside the unformed stator tube 12, possibly in a pressurized state.

Once the stator tube 12 is filled with fluid, the intensifier cylinders 68 are moved axially inwardly. The intensifier cylinders 68 can be moved in a variety of manners, such as by introducing pressurized fluid in the axially outer portion of the intensifier chambers 64, by a motor, or the like. As each intensifier cylinder 68 is moved axially inwardly, the associated intensifier rod 70 is urged deeper inside the stator tube 12. The axial movement of the intensifier rods 70 increases the pressure of fluid inside the stator tube 12, thereby deforming the stator tube 12 radially outwardly. In this manner the stator tube 12 expands radially outward, conforming against the inner surface 75 of the die 74 to provide the desired helical screw shape to the inner and outer surfaces of the stator tube 12.

At the same time that the intensifier rods 70 and cylinders 68 are moved axially inwardly, the forming cylinders 54 and associated clamps 52 may also be moved axially inwardly. The forming cylinders 54 can be moved in a variety of manners, such as by introducing pressurized fluid in the axially outer portion of the forming chambers 56, by a motor, or the like. The axial movement of the clamps 52 places the stator tube 12 in a state of compression, which aids in the hydroforming of the stator tube 12. In particular, when the stator tube 12 is deflected radially outwardly, it also shrinks in the axial direction to accommodate the radial expansion. Thus, placing the stator tube 12 in a state of compression during hydroforming helps to flow the material to the desired shape (i.e. analogous to a cylinder bulging outwardly when placed in compression) and reduces the fluid pressures needed to hydroform the stator tube 12.

The hydroforming process described and shown herein may be a "hot" hydroforming process wherein the stator tube 12 and/or hydraulic fluid is heated to increase the ductility of the stator tube 12, and thereby reduce the force necessary to hydroform the stator tube 12. Hot hydroforming can be particularly useful when relatively large expansion ratios for the stator tube 12 are required. In this case, the heat applied to the stator tube 12 increases its ductility and allows for more expansion than would otherwise be possible. For example, the stator tube 12 may be heated by resistance heating methods (i.e. passing an electrical current through the stator tube 12). In this case the die 74 is preferably made of an electrically insulating material, such as ceramic material, to minimize transfer to the die 74.

In the illustrated embodiment, an axial forming cylinder 54 and an intensifier cylinder 68 are provided at each end of the stator tube 12/stator tube forming device 50. However, if desired, only a single forming cylinder 54 and/or a single intensifier cylinder 68 may be utilized, and the other end may be fixed. In this case the forming cylinder 54 and intensifier cylinder 68 can be located at the same, or opposite, axial ends.

The illustrated embodiment also shows a coaxial arrangement for the forming cylinder 54 and the intensifier cylinder 68 wherein the forming cylinder 54 is positioned axially inwardly relative to the intensifier cylinder 68. However, if desired this arrangement could be reversed such that the intensifier cylinder 68 is positioned axially inwardly relative to the forming cylinder 54.

The illustrated embodiment also shows an forming cylinder 54 that is separate and distinct from the intensifier cylinder 60. This allows the fluid pressure (i.e. the radial forces) and the compression forces applied to the stator tube 12 to be individually controlled. However, if desired, only a single cylinder/piston may be used for both axial forming and intensifying. In this case, for example, the intensifier rod 70 of FIGS. 3 and 4 may be directly coupled to the cylinder 54, and the intensifier chamber 64 and cylinder 68 may be omitted.

The illustrated embodiment also shows a female die 74 wherein the tube 12 is positioned inside the die 74. However, the system described herein can also be used when the tube 12 is positioned outside/around a male die, although this embodiment can be more difficult to implement as it can be difficult to remove the formed stator tube 12 from the die. Moreover, the stator tube 12 can be formed by a variety of methods besides hydroforming, such as rotary swaging, casting, machining, or similar methods. Moreover, various other stator components besides the stator tube 12 can be formed by the hydroforming method and device 50 shown herein, such as the stator liner 14.

The stator tube 12 can be made of a variety of materials such as metal, or any of the materials outlined above as materials for the stator liner 14. The stator tube 12 may have any of a variety of thicknesses, such as between about 0.125 inches and about 0.25 inches, or at least about 0.125 inches, or at least about 0.25 inches. A thickness that is too large can make hydroforming too difficult, and a thickness that is too small can provide a stator tube 12 that cannot withstand pressures generated during operation of the pump 10. The stator tube 12 may thin slightly during hydroforming, but such thinning would typically be minimal (i.e. less than about 5%, or less than about 1%, reduction in thickness). In particular, because the ends of the stator tube 12 are constrained/compressed during hydroforming, the wall thickness of the stator tube 12 can be controlled. As the stator tube 12 expands radially, it will tend to thin slightly due to volumetric change. However, by compressing the ends of the stator tube 12, the thickness of the stator tube 12 can be maintained and controlled by shrinking the stator tube 12 in the axial direction. Thus thinning of the stator tube walls can be controlled/maintained.

Once the stator tube 12 is formed, the stator liner 14 can be formed or placed on an inner surface of the stator tube 12. The stator liner 14 can be formed in a variety of manner, such as hydroforming in a manner similar to that described above for the stator tube 12. The stator liner 14 can also be formed by machining, molding, extrusion, etc. The stator liner 14 can then be positioned or threaded into the stator tube 12 to form the stator assembly 11. Alternately, rather than forming the stator liner 14 as a separate portion and then positioning the stator liner 14 inside the stator tube 12, the stator liner 14 can be molded in place on the inner surface of the stator tube 12 (i.e. by injecting the liner material in a liquid state and allowing the liner material to cure).

As shown in FIG. 2, the stator liner 14 may include a generally radially-outwardly extending flange portion 76 at each end that is integral, or unitary, or formed or molded as one piece, with the remaining portions of the stator liner 14. Each flange portion 76 extends radially beyond the remaining portions of the stator liner 14 and extends axially beyond the stator tube 12. Each flange portion 76 may include an annular seal component 78, which can be a bulge or area of increased material, extending around the periphery of each flange 76. Alternately, each seal component portion 78 may have a hollow center and be formed as an O-ring similar to a sanitary gasket. Moreover, although the seal components 78 are shown as being integrally molded with the associated flange 76, if desired each seal component 78 can be a separate component from the associated flange 76.

The stator tube 12 may include a generally radially-outwardly extending flange portion 80 positioned adjacent to each stator liner flange portion 76. Each flange portion 80 of the stator tube 12 may terminate in an outer angled or beveled edge 82. Each stator tube flange portion 80 may be coupled to associated, adjacent pump component (i.e. an inlet or transition housing 84 at one end and an outlet tube 86 at the other end in the illustrated embodiment). Each adjacent pump component 84/86 may include an angled or beveled edge 88 positioned immediately adjacent to, and opposite, a beveled edge 82 of the stator tube 12.

In order to couple the stator 11 to the inlet housing 84/outlet tube 86, an annular end flange 90, with a pair of inner angled or beveled surfaces 92, is positioned such that the end flange 90 spans and engages the beveled surfaces 82/88. The end flange 90 may be placed in a state of radial compression (i.e. by radially squeezing the end flange 90) or radial tension (i.e. by providing a split end flange 90 that is slightly smaller in diameter than the end portions of the pump components 84/86) thereby squeezing the flange portions 76 (and seal component 78) of the stator liner 14 between the stator tube flange portion 80 and inlet housing 84/outlet tube 86, due to interaction between the beveled surfaces 82, 88. In fact, the seal components 78 may be compressed generally flat, although they are not shown in this condition for illustrative purposes. Thus, in this case the end flange 90, beveled surfaces 82, 88 and flange portion 76 provide a fluid-tight seal at the axial ends of the stator 11, and provide a seal that is easy to install and disassemble.

Figure 5:
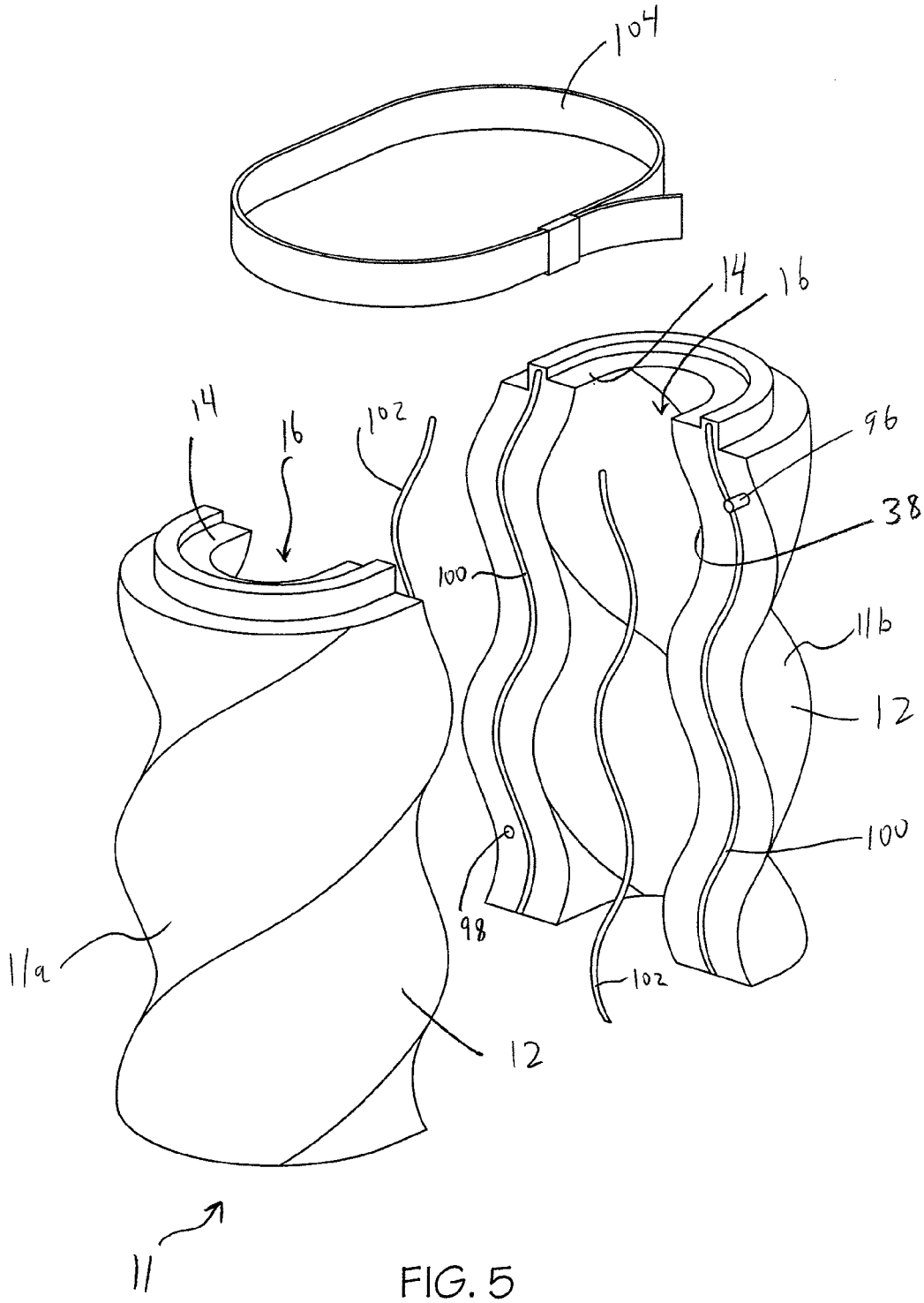
FIG. 5 is a perspective view of two stator portions.

As shown in FIG. 5, the stator 11 may be a split stator which is split into two stator portions 11*a*, 11*b* along its longitudinal axis. The split or seam between the stator portions 11*a*, 11*b* may extend through the entire thickness of the stator 11; that is, from the outer surface entirely through to its inner (helical) surface 38, and may extend the entire length of the stator 11. The split nature of the stator 11 allows the stator 11 to be removed from the rotor/pump without having to completely disassemble the pump 10, unthread the rotor 18, etc. Instead, in this case the stator 11 can be easily removed in the radial direction (and without intersecting the central axis of the rotor/pump) which allow for easy access for repair, maintenance, etc. of the stator 11, rotor 18, and other pump components. Moreover, when the stator 11 is an equal wall stator, the reduced weight of the stator tube 12 improves the ease of removing and handling of the stator portions 11*a*, 11*b*. When the stator 11 is an equal wall stator formed by hydroforming or other methods, the stator 11 may be split into stator portions 11*a*, 11*b* after or before the stator 11, or stator tube 12, is formed.

In addition, the stator tube 12 need not necessarily have a helical outer surface (i.e. the stator 11 need not be an equal wall stator). For example, the outer surface of the stator tube 12 can have a cylindrical, square, or other shapes. In addition, the stator tube 12 need not necessarily be formed by hydroforming, but could be formed by rotary swaging, casting, machining, or similar methods.

The split portions 11*a*, 11*b* can be aligned and coupled together by various structures and mechanisms such that the portions 11*a*, 11*b* abut against each other along generally axially-extending seams. Each seam may intersect or be positioned immediately adjacent to the inner surface 38 of the stator 11, and the rotor 18 may simultaneously engage both stator portions 11*a*, 11*b*. In the embodiment of FIG. 5, each stator portion 11*a*, 11*b* includes a transversely extending peg 96 at one end and a correspondingly shaped opening 98 at its other end. Each peg 96 fits into a corresponding opening 98 on the other stator portion 11*a*, 11*b* to help align and couple the stator portions 11*a*, 11*b*. The pegs 96/openings 98 may be arranged such that the stator portions 11*a*, 11*b* can be assembled in only a single, desired configuration.

Moreover, in the illustrated embodiment each stator portion 11*a*, 11*b* includes a pair of opposed grooves 100 extending the length of the stator portions 11*a*, 11*b*. A sealing component 102 can be positioned in partially in each groove 100 to help seal and align the stator portions 11*a*, 11*b* along the axial direction. The sealing component 102 can be made of a variety of materials, such as o-ring material (i.e. a hollow tube) or other suitable components. If desired, each groove 100 may be slightly smaller in diameter than the sealing component 102 to ensure the sealing components 102 form an appropriate seal.

Various clamps, rings, and the like can be positioned about the periphery of the stator 11 to keep the stator portions 11*a*, 11*b* in place. For example, as shown in FIG. 5 a clamp or belt 104 (or multiple clamps 104, not shown) may extend around the stator portions 11*a*, 11*b*, and form a loop that presses the stator portions 11*a*, 11*b* together. The use of clamps, rings and the like also help to press the internal faces of the stator portions 11*a*, 11*b* together to form a tight seal therebetween along the length of the split. The clamps, rings and the like may be positioned at the axial ends of the stator 11, although intermediate clamps, rings and the like may also be used.

The split nature of the stator 11 can also be exploited to address jamming or clogs in the pump. In particular, in the event of a jam or clog, the clamps 104, rings and the like compressing the stator portions 11*a*, 11*b* together may be loosened, thereby allowing the split portions 11*a*, 11*b* to move radially outwardly which can allow unusually large masses to pass through the stator 11. Once the large mass has passed through, the clamps 102, rings and the like may be tightened back down. This procedure can be utilized to enable quick servicing of the pump 10 without disassembly. Alternately, the state of compression of the stator portions 11*a*, 11*b* can be adjusted (i.e. loosened) and left in that state to correspondingly adjust the pump characteristics.

In the illustrated embodiment the stator 11 is split by a plane extending through its central axis to provide two equally-sized (i.e. 180°) stator portions 11*a*, 11*b*. However, if desired the stator 11 can be split in other configurations such that the stator portions 11*a*, 11*b* are not equally sized (i.e. a 150° portion and a 210° portion). Moreover, if desired, multiple splits may be provided such that the stator 11 is split into three, four, or more stator portions. These variations may be useful if there are structures surrounding or immediately adjacent to the pump 10 that may hinder access. In this case the stator portions 11*a*, 11*b* can be configured such that the stator portions 11*a*, 11*b* can be lifted radially away from the pump 10 in a manner that avoids the surrounding structures.

The rotor 18, stator 11, inlet housing 84, suction chamber 44 and outlet tube 86, along with all of the surfaces to which the pumped materials are exposed (i.e. the wetted surfaces of the pump 10) may be made of material appropriate for sanitary applications. For example, these surfaces may be made of a relatively hard, non-absorbent and easy to clean material, such as polished stainless steel or nearly any stainless, carbon or alloy steels. Moreover, the flanges 76/sealing components 78 of the stator 11 form a fluid-tight seal to help eliminate any crevices or dead spaces, thereby improving the sanitary nature of the pump 10. The ability to easily access the stator 11 and rotor 18, provided by the split nature of the stator 11, allows easy cleaning of the stator and rotor to improve the sanitary nature of the pump 10. Moreover, the split stator 11 can be easily accessed and replaced. Stators 11 may need to be replaced more frequently in sanitary applications since any significant pitting or wear of the stator 11 can defeat the sanitary nature of the pump.

The seals and bushings in the pump 10 may be made of a sanitary material that is approved/appropriate for use in sanitary applications (i.e. made of FDA-approved materials). These features may be implemented such that pump can process foods, food additives and other materials for human consumption, although the pump 10 can also be used to pump various other materials.

Having described the invention in detail and by reference to the preferred embodiments, it will be apparent that modifications and variations thereof are possible without departing from the scope of the invention.

What is claimed is:

1. A method for making a stator assembly comprising the steps of:

providing a generally cylindrical stator casing;

hydroforming said stator casing into a generally helical shape while said stator casing is in a state of axial compression due to forces applied to an axial end of said stator casing, wherein said hydroforming step includes filling said stator casing with a fluid, placing a mold about said stator casing, and increasing the pressure of said fluid by inserting an intensifier rod into said stator casing to cause said stator casing to expand radially outwardly and conform to said mold, and wherein the axial compression of said stator casing and the movement of said intensifier rod are independently controllable; and positioning a stator liner having a generally helical shape inside said stator casing.

2. The method of claim 1 wherein said stator liner has a generally helical inner surface.

3. The method of claim 1 wherein said hydroforming step includes hydroforming said stator casing such that both an inner surface and an outer surface of said stator casing have a generally helical shape.

4. The method of claim 1 wherein said positioning step includes molding said stator liner inside said stator casing, or threading said stator liner into said stator casing.

5. The method of claim 1 further comprising the step of inserting a rotor, having a helical outer shape, into said stator.

6. The method of claim 1 wherein said stator casing includes a generally radially-extending flange portion at an end thereof, and wherein said flange portion includes a beveled outer edge.

7. The method of claim 6 further comprising the step of providing an end flange having a pair of beveled inner surfaces, and positioning said end flange over said beveled outer edge of said flange portion and over a beveled edge of a pump component to thereby sealingly couple said stator casing and said pump component.

8. The method of claim 1 further comprising the step of, after said hydroforming step, axially splitting said stator assembly into at least two stator portions.

9. The method of claim 1 wherein said stator casing and said stator liner are made of differing materials.

10. The method of claim 1 wherein said stator casing is metal and said stator liner is a polymer material.

11. The method of claim 1 wherein said mold is generally continuous and surrounds the entirety of said stator casing.

12. The method of claim 1 further including the step of, before said positioning step, accessing said stator liner that is pre-formed and separate from said stator casing.

13. A method for making a stator comprising the steps of:

providing a generally cylindrical stator component; and hydroforming said stator component into a generally helical shape, wherein said hydroforming step includes filling said stator component with a fluid, placing a mold about said stator component, and increasing the pressure of said fluid by inserting an intensifier rod into said stator component to cause said stator component to expand radially outwardly and conform to said mold, wherein said hydroforming step includes placing said stator component in a state of axial compression, and wherein the axial compression by applying an axial compression force to an axial end surface of said stator component of said stator component and the movement of said intensifier rod are independently controlled.

14. The method of claim 13 wherein said intensifier rod is inserted into said stator component after said stator component is filled with said fluid.

15. The method of claim 13 wherein said mold is generally continuous and surrounds the entirety of said stator component.

16. The method of claim 13 further comprising the step of positioning a stator liner having a generally helical shape inside said stator component, wherein said stator liner includes a generally radially-extending flange portion at each end thereof and generally extending axially beyond said stator casing, and wherein said flange portion includes a unitary seal component formed therewith, wherein said seal component has an increased thickness compared to adjacent areas of said flange portion.

* * * * *

UNITED STATES PATENT AND TRADEMARK OFFICE

CERTIFICATE OF CORRECTION

PATENT NO. : 8,215,014 B2
APPLICATION NO. : 11/931372
DATED : July 10, 2012
INVENTOR(S) : Michael D. Amburgey It is certified that error appears in the above-identified patent and that said Letters Patent is hereby corrected as shown below:

Column 9, Line 2, reads: "ponent in a state of axial compression and wherein the"
it should read -- ponent in a state of axial compression by applying an --

Column 9, Line 3, reads: "axial compression by applying an axial compression"
it should read -- axial compression force to an axial end --

Column 9, Line 4, reads: "force to an axial end surface of said stator component of"
it should read -- surface of said stator component, and wherein --

Column 9, Line 5, reads: "said stator component and the movement of said inten-"
it should read -- the axial compression of said stator component and the --

Column 9, Line 6, reads: "sifier rod are independently controlled."
it should read -- movement of said intensifier rod are independently controlled. --

Signed and Sealed this
Sixteenth Day of October, 2012

David J. Kappos

David J. Kappos
*Director of the United States Patent and Trademark Office*